United States Patent [19]

Govan et al.

[11] Patent Number: 4,541,764

[45] Date of Patent: Sep. 17, 1985

[54] DOCUMENT STACKING AND CONVEYING APPARATUS

[75] Inventors: Edward Govan, Stratford; Robert Irvine, Riverside, both of Conn.

[73] Assignee: Pitney Bowes Inc., Stamford, Conn.

[21] Appl. No.: 613,560

[22] Filed: May 24, 1984

[51] Int. Cl.[4] ..... B65H 39/02

[52] U.S. Cl. ..... 414/52; 414/43; 414/89; 414/907

[58] Field of Search ..... 414/29, 41, 43, 46, 414/52, 89, 907; 198/422; 271/3.1

[56] References Cited

U.S. PATENT DOCUMENTS 3,150,614 9/1964 Scarpa ..... 198/422 X

FOREIGN PATENT DOCUMENTS 40701 12/1968 Finland ..... 198/422

434503 9/1935 United Kingdom ..... 414/52

*Primary Examiner*—Robert J. Spar

*Assistant Examiner*—Janice Krizek

*Attorney, Agent, or Firm*—Martin D. Wittstein; William D. Soltow, Jr.; Albert W. Scribner

[57] ABSTRACT

A document stacking and conveying apparatus has a plurality of document stacking and conveying units which are disposed at one end of a third elongate document stacking and conveying apparatus. The third unit has a conveyor for moving a stack of documents while a compressing device holds another stack which is stationary upon the conveyor deck of the third unit so that the moving stack of documents can be added to the downstream stack.

6 Claims, 5 Drawing Figures

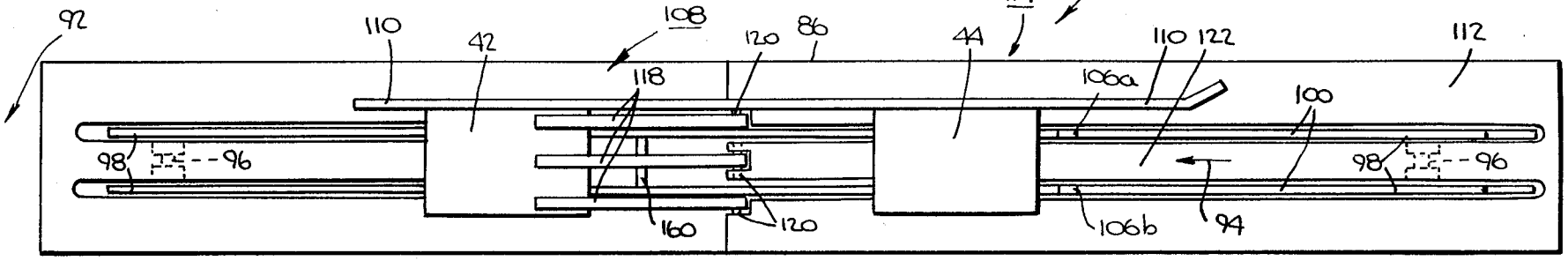
Fig. 4.
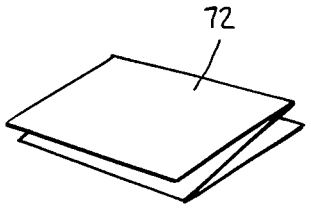
Fig. 4A.
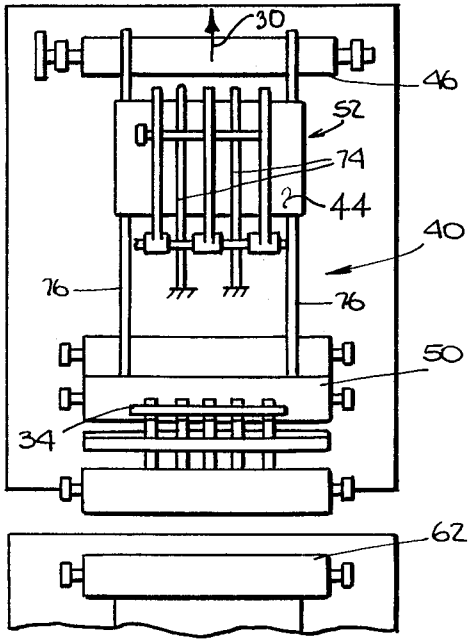
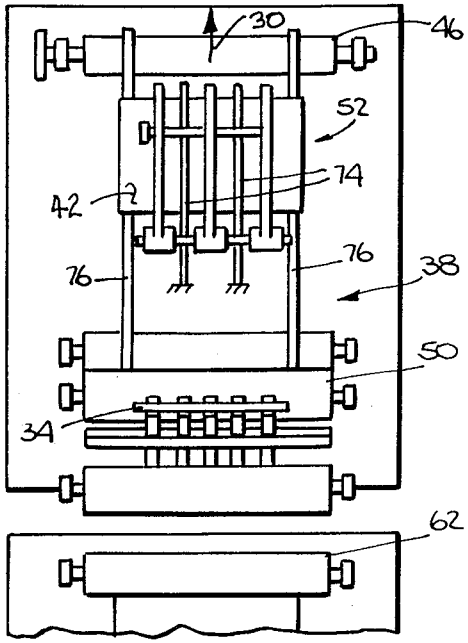

DOCUMENT STACKING AND CONVEYING APPARATUS

FIELD OF THE INVENTION

The present invention is directed to a document stacking and conveying apparatus which is utilized for combining various stacks of documents into a single stack of documents. Once the single stack of documents is assembled, it may be inserted into envelopes which are provided from, for example, an inserting machine. The document stacking and conveying apparatus includes a pair of elongate document stacking and conveying devices which feeds stacks of documents along separate paths leading to a third conveying device. The first and second conveyors are arranged in parallel relationship to intermittently feed stacks of documents to the third document stacking and conveying device which is arranged at one end of the first and second conveyors.

BACKGROUND OF THE INVENTION

There has been a recurring problem in maintaining the accumulated stack of documents in a vertically compact stack to which other stacks of documents may be added. In the art of conveying material, and particularly in the present case, where documents have been folded and then stacked, it is necessary to be concerned about having a clear path over the top of a stack of documents to which additional documents are to be added since any potential interference will immediately cause a jam where the new documents are added to the original stack. There is a natural tendency for documents in a stack to billow upwards, when they are supported beneath the stacks. And, documents which are folded have an even greater tendency to billow upwards in a stack. As is described in the accompanying specification, the folded documents originate from a continuous perforated web, which is typically fan folded into a supply stack, located upstream of the document conveyors.

It is absolutely essential to the operation of the document handling apparatus described herein that there be a clear, unobstructed path for the documents, or stack of documents to be processed through, especially at those locations where collation of one stack of documents must be made with one or more others. It is for this reason that the present invention has evolved and is being brought forward, as is briefly defined in the following summary.

SUMMARY OF THE INVENTION

The present invention is directed to a document stacking and conveying apparatus in which there is a number of elongate stacking and conveying devices which are used to accumulate a stack of documents. There is a compression device included with one of the document stacking and conveying devices for pressing one stack of documents down while another stack is deposited on top of the other.

More broadly, the present invention is directed to a document stacking and conveying apparatus having a pair of elongate document stacking and conveying devices which are arranged in parallel relationship to each other. Each stacking and conveying device has an apparatus for accumulating a plurality of documents into a stack adjacent to one end of the document stacking and conveying device. Another document stacking and conveying device is disposed in perpendicular relationship to the pair of document stacking and conveying devices adjacent to one end of the pair of document stacking and conveying devices for receiving the stacks of documents therefrom and for stacking the stacks one on top of another. There is an apparatus located adjacent to one end of the pair of document stacking and supporting devices for receiving stack of documents therefrom. And, there is a conveyor device extending along the third elongate document stacking and conveying device for sequentially moving one of the stacks toward the other while the other stack remains stationary on the stack receiving and supporting device and for moving both stacks after the one stack has been deposited on top of the other stack. And, there is a device disposed between the stacks for compressing the other stack toward the receiving and supporting device and for guiding the one stack upwardly from the receiving and supporting device so that the one stack is deposited on top of the other stack by the conveyor device while the other stack remains stationary.

There is a fixed inclined guide element mounted on the receiving and supporting device. A movable guide element is pivotably connected to the upper end of the fixed guide element so that it extends in a direction overlying the other stack. And, there is a device for moving the moveable guide element downwardly to compress the other stack and to guide the one stack on top of the other stack. An upwardly biased cam device is moveably connected to the other document stacking and conveying device adjacent to a lower run of an endless member. The moveable guide element is connected by a device to the cam device for movement therewith. Pusher members which are carried upon the conveyor device have a cam surface for engagement with the cam device during movement of the pusher members along a lower run moves the cam device downwardly to depress the moveable guide element.

Therefore, having briefly described the document stacking and conveying apparatus, it will be appreciated that it is an object of the present invention to provide a document stacking apparatus which will permit adding documents to the top of a stack of documents which are moving along a common predetermined path.

DESCRIPTION OF THE DRAWINGS

FIG. 4 represents a partial plan view of the apparatus of FIG. 1 generally taken along the lines of 4—4 of FIG. 1.

FIG. 4A represents an isometric view of a folded document having exited from the folding device of the present invention.

DESCRIPTION OF THE PREFERRED EMBODIMENT

Figure 1:
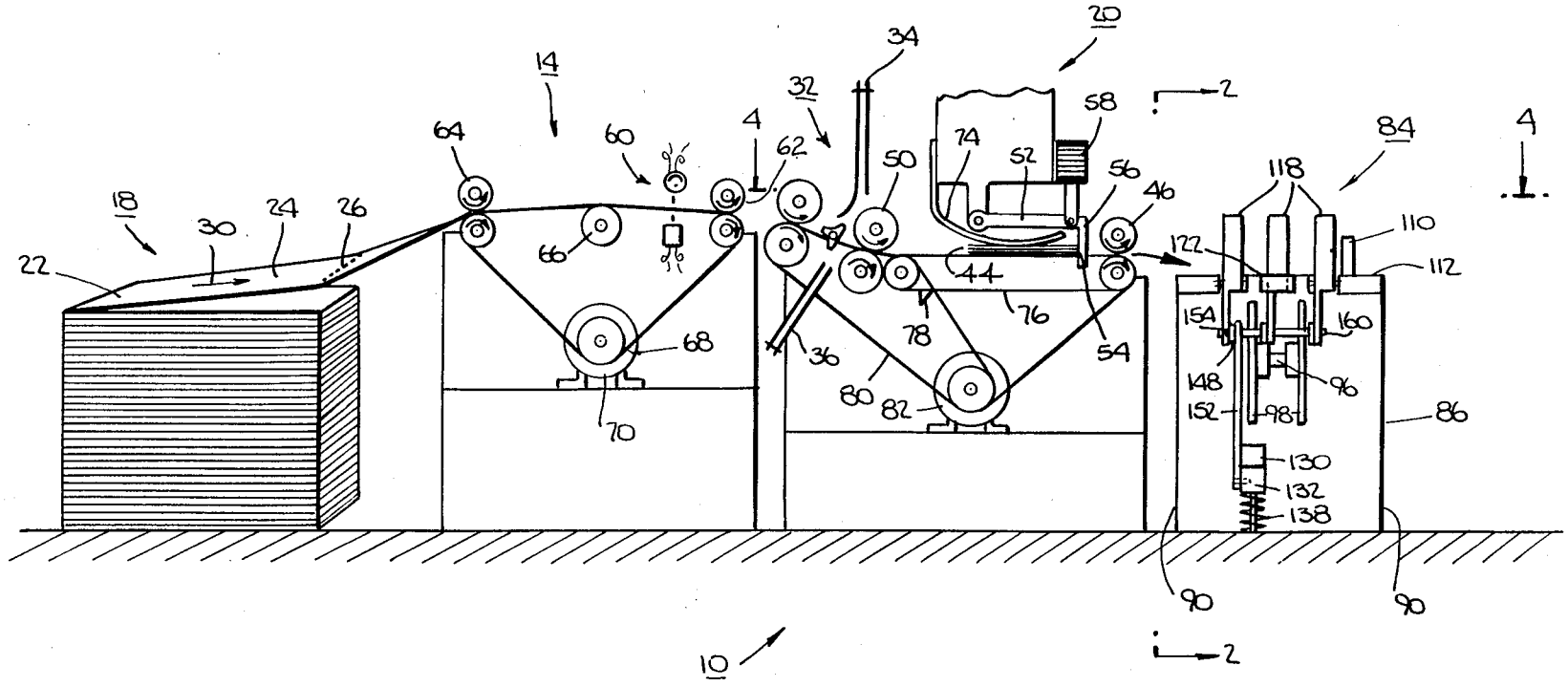
FIG. 1 represents an end view of the document stacking and conveying apparatus of the present invention.

Referring to FIG. 1, there is shown a document stacking and conveying apparatus 10, including a pair of bursting machines 14. The bursting machines 14 are each provided with a supply of fan folded computer form documents 18. The documents 18 are supplied in a form represented by a perforated web 22 which is separately guided into a pair of elongate document stacking and conveying devices 20. Each perforated web 22, has discrete documents like a discrete document 24, located between spaced apart perforations such as a perforation 26. There is a separate path of travel 30, with respect to each perforated web 22.

The bursting machines 14 are utilized to separate the discrete documents as they are conveyed along each separate path of travel 30 so that individual stacks of documents are accumulated downstream in a predetermined numerical order or arrangement. Further yet downstream of the bursting machines 14, there is a pair of folding devices 32, which each have a first buckle chute 34, and a second buckle chute 36. Each buckle chute has appropriate deflecting devices, and buckle chute stops for diverting the discrete documents and causing each document to stop in order for the intended document folds to take place. The folding process will not be discussed in detail herein, since it is well known in prior art as to how to fold sheet material or the like by using rollers such as those illustrated within the accompanying drawings. The pair of folding devices 32 do utilize folding rollers as such to create the desired folds which in the present case is a "Z" type fold.

There is a first and second elongate document stacking and conveying apparatus 38 and 40, (FIG. 4), respectively which cyclically advances a first stack 42 and a second stack 44 at a predetermined time, controlled by an electronic control device (not shown), but understood to be part of the document stacking and conveying apparatus 10. The conveying apparatus 38 and 40 as such each have a pair of conveying rollers 46 which are continuously driven while the document stacking and conveying apparatus 10 is operating. There is a pair of conveying rollers 50 in each pair of folding devices 32 which eject the folded documents so that they accumulate into the aforementioned stacks 42 and 44 at a registration stop. There is a pivotable registration apparatus 52 (FIG. 1) appropriately secured to structure (not shown), of the apparatus 10 in order to engage the first and second stacks 42 and 44 at a registration stop surface 54 which is part of a plurality of arms 56 of each pivotable registration apparatus 52. A solenoid 58 is appropriately connected to the pivotable registration apparatus 52, while being firmly secured to the (unshown) structure previously mentioned which supports the pivotable registration apparatus 52 as well.

It is important to mention, that there is a printed, predetermined system of coded marks located on each discrete document within the perforated web 22 for controlling the operation and sequence of events in the document stacking and conveying apparatus 10. This is a very well known system that is used to control operation of such equipment as is being presently described. There is in the present apparatus a scanning device 60, which is positioned along the path of travel 30 of each perforated webb 22 so that the scanning device 60 intercepts and reads the predetermined code. Accordingly, through an electronic counting and control system, the required actuation of the devices being described are accomplished in a prescribed manner. The scanning device 60 is located within the pairs of the bursting machines 14 such that the coded marks are read upstream of the folding devices 32 since it becomes difficult to read the marks after the documents are folded.

The pair of bursting machines 14, each have two pairs of conveying rollers, and it is intended that a first pair of conveyor rollers 62 in each bursting machine 14 has a rotational speed twice that of a second pair of conveying rollers 64. The differential in speed between the pairs of rollers causes the discrete documents in each perforated web 22 to break apart, once the perforation 26 (for example) is positioned over a bursting cone 66, which helps the perforation 26 and thus the discrete documents to separate from the remainder of the perforated web 22. The first and second pairs of conveying rollers 62 and 64 in each of the bursting machines is powered by a drive system 68, which includes a motor 70 which as mentioned provides the rotational power for the conveying roller system in each of the pairs of bursting machines 14. Briefly, the bursting cone 66 is typical of a device, such as a roller or other blunt member which will effectively cause the perforations normally joining the discrete documents in a continuous web to quickly separate or burst when the device is located in a position to slightly interfere with the normal path of travel of documents between conveying rollers such as these described above.

Referring briefly to FIG. 4, and especially to FIG. 4A, there is shown an individual folded discrete document 72, which is typical of the folded documents ejected by the pair of conveying rollers 50 in each of the pair of folding devices 32. Upon ejection from the pair of conveying rollers 50, the folded documents travel forward, under a plurality of spring like hold down members 74, which serve to compress the folded documents accumulating in the aforementioned first and second stacks 42 and 44.

It is predetermined that each respective stack 42 and 44 be ejected to a further downstream position for purposes which will now be explained. To help this function occur, each respective elongate document stacking and conveying apparatus 38 and 40 has a cyclicable chain conveyor 76, having a pair of pusher members 78. The cyclicable chain conveyor 76 is arranged in each document stacking and conveying apparatus 38 and 40 to be operatively engaged with an electromagnetic clutch (not shown), which when activated is rotatively powered by a drive system 80, which is connected to a motor 82. The motor 82 additionally provides the required rotational input to the aforementioned conveying rollers 46.

The first stack 42 is advanced when the solenoid 58 is energized to lift the pivotable registration apparatus 52, thereby clearing a path for the first stack 42 to be pushed along by the pusher members 78. The first stack 42 is pushed downstream to the conveying rollers 46 which are rotating at a substantially higher speed than the pusher members 78, in order to accelerate the first stack 42 forward. As a result of the increased speed of the conveying rollers 46 the pusher members 78 do not interfere with the trailing edge of the stack 42. This portion of the document stack conveying function is controlled by the machine electronic control device, which as previously mentioned is triggered by the electronic controls activated by the scanning device 60, located upstream in the path of travel 30. Simultaneously the second stack 44 is being advanced with the release of its pivotable registration apparatus 52. The result is that both the first and second stacks 42 and 44 are advanced through the conveying rollers 46 such that they are ejected towards another (third) elongate stacking and conveying apparatus 84.

The third elongate stacking and conveying apparatus 84 is arranged with respect such that it is in a perpendicular relationship to the first and second elongate stacking and conveying apparatus 38 and 40. The third conveying apparatus 84 is fixed upon a structure 86, which is appropriately supported upon ground as is the remainder of the document stacking and conveying apparatus 10. The structure 86 is somewhat lower than the first and second units 38 and 40 and includes a pair of frames 90 which the following described components and parts are suitably fixed or supported by. For example, there is a drive apparatus (not shown), which is appropriately mechanically coupled to the mechanical drive system of an inserting machine (not shown), but understood to be located at a downstream position 92 with respect to a path of travel of documents flowing along the third elongate stacking and conveying apparatus 84.

A pair of spaced apart shafts 96 (FIG. 2) are suitably located for rotatably supporting two pairs of conveying chain sprockets 98, which in turn support a pair of conveyor chains 100. The conveyor chain members 100 each have an upper horizontal run 102, and a lower horizontal run 104. As previously mentioned, as unshown drive system is operatively engaged with the third elongate stacking and conveying apparatus 84, such that the conveying chain sprockets 98 are continuously driven to cause the conveyer chains 100 to cycle. There is a plurality of conveyor pusher members 106, which are appropriately attached to the conveyor chains 100 at spaced intervals, for predetermined engagement with the first and second stacks 42 and 44 as will now be described.

Figure 2:
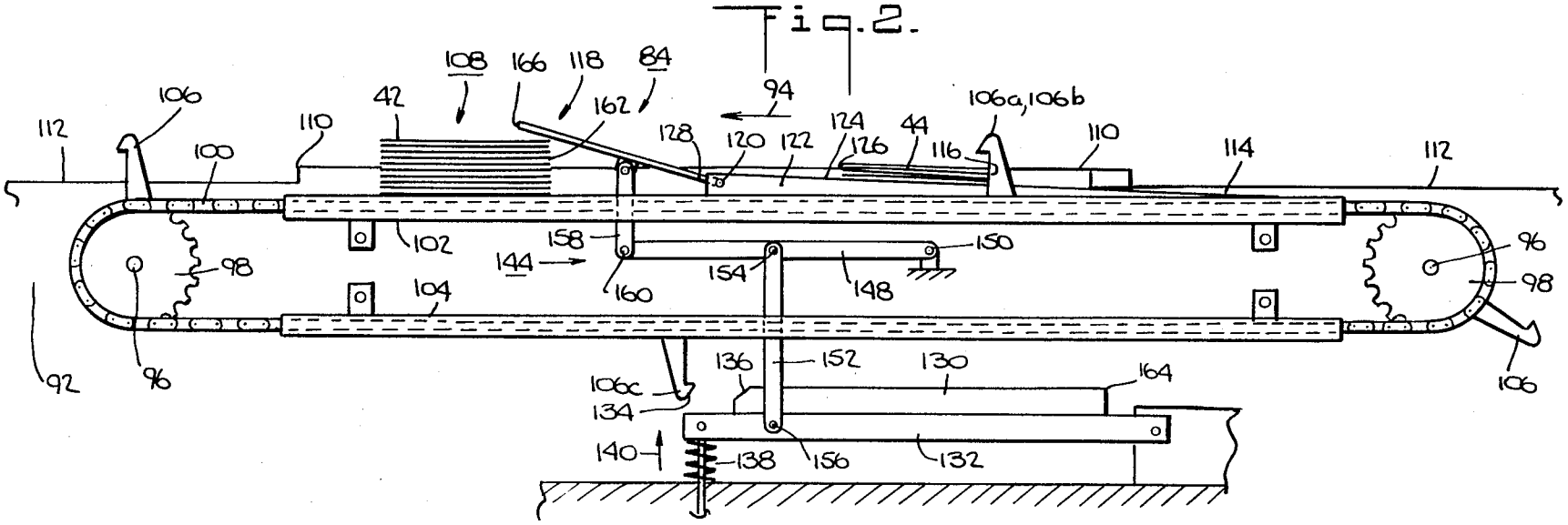
FIG. 2 represents a view generally taken along the lines 2—2 of FIG. 1, illustrating the third elongate document stacking and conveying device with the compressing device in a normally inclined position.

The first stack is ejected from the conveying rollers 46, as was previously described, and is effectively propelled towards the third elongate stacking and conveying apparatus 84 where it is stopped at a receiving and supporting station 108. A fixed abutment member 110, securely fastened to a fixed conveyor deck 112, serves to stop the first and second stack 42 and 44 temporarily until the pair of conveyor chains 100 engage them. The second stack 44 is propelled unto the third conveying apparatus 84 at an upstream location 114 and as mentioned, stops against the fixed abutment member 110 while a pair of document pusher members **106*a* and 106*b* engage an end 116 of the second stack 44 (FIG. 2). Meanwhile, the first stack 42 remains stationary at the receiving and supporting station 108, being located beneath a plurality of ramp like members which are appropriately connected together to form a movable guide element 118 which is suitably hinged at a pin 120. The pin 120 is supported by a fixed, inclined guide element 122 of the fixed conveyor deck 112. The fixed, inclined guide element 122 is angled to be higher at the movable guide element 118 pivot, and slopes downwards like a ramp to the level of the fixed conveyor deck 112 at the upstream location 114. The second stack 44 is pushed along a surface 124 of the raised portion of the fixed inclined guide element 122 so that a leading end 126 of the second document stack is elevated to engage a lower portion 128 of the movable guide element 118 after the pusher elements 106*a* and 106*b* have pushed the second stack 44 a short distance along the path of travel 94**.

At the instant that the second document stack 44 engages the movable guide element 118 at the lower portion 128, a pusher element **106*c* engages a cam member 130 which is adjustably mounted upon a pivotable member 132. There is a cam surface 134 on each pusher element 106 which helps to cushion the shock of engagement with the cam member 130, which has a cam surface 136 for matching the pusher element 106*c*. A biasing member 138 in the form of a compression spring normally urges the pivotable member 132 upwards in the direction represented by an arrow 140**.

Figure 3:
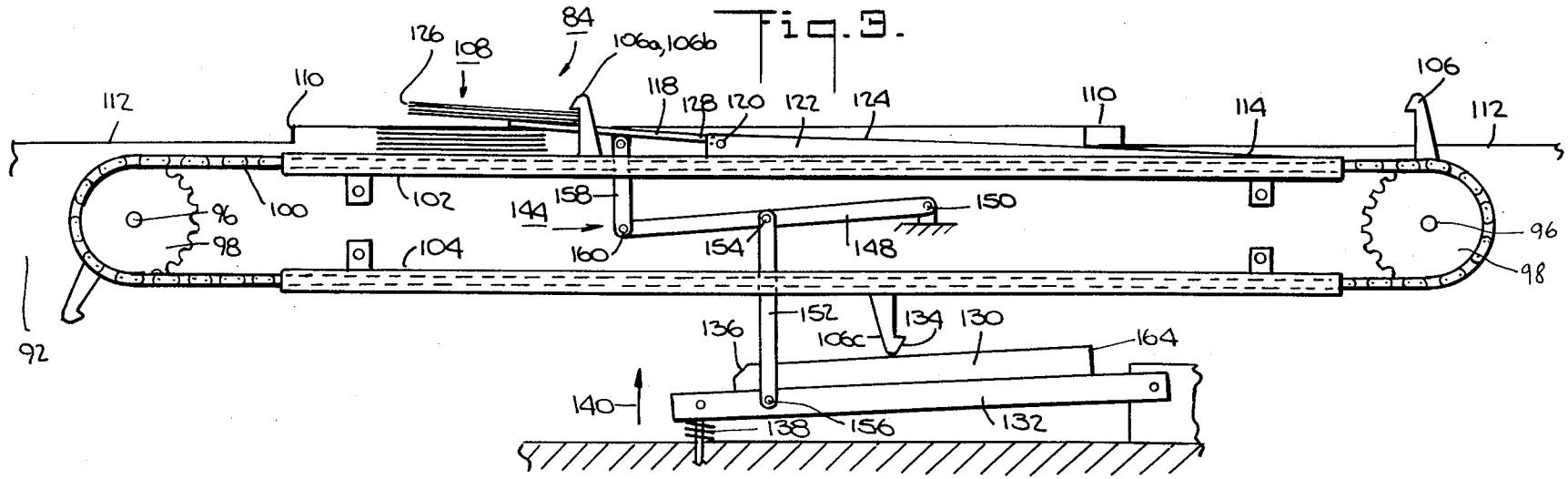
FIG. 3 represents a view similar to FIG. 2, with the compressing device shown in the stack compressing position while another stack is added to the top.

Referring to FIG. 3, it is seen that the document pusher elements **106*a* and 106*b* are moving in a path towards the movable guide element 118, and are in effect engaged with the second stack 44 while forcing the second stack 44 to reposition on top of the first stack 42. Meanwhile, the movable guide element 118 is being held down in a substantially horizontal position 140 by means of the interconnecting linkage to now be described. There are attached components which comprise a three part linkage assembly 144 for interconnecting the pivotable member 132 and the movable guide element 118. The purpose for all of the aforementioned interconnected components, is readily apparent since it will be recognized that the first stack 42 is being mechanically compressed downwards while the second stack 44 is being conveyed to an overlying position on top of the first stack 42 as shown in FIG. 3. The interconnecting components which accomplish this includes a first pivoting link 148 which is suitably supported and hinged by a pin 150. The pin 150 is connected to the structure 86 of the third elongate stacking and conveying apparatus 84. A second link 152 is suitably connected to the first pivoting link 148 and the pivotable member 132 by a pin 154 and 156 respectively so that the links 152, 148 and the pivotable member 132 act as a rotating four bar linkage. A set of third links 158 is similarily connected by a pin 160 at the lower and to the first pivoting link 148 while being separately connected to the movable guide element 118, (which in the present case is three pieces, in order to straddle the pair of conveyor chains 100**).

Thus, the foregoing described connecting linkage provides the means to transfer a motion initiated by the pusher element **106*c* acting to pull downwardly the linkage to effectively pull down the movable guide element 118 which then compresses the first stack 42 while the second stack 44 is positioned over the first stack 42. Meanwhile, the second stack 44 is continuously pushed along the path of travel 94, by a pusher element 106*a* and 106*b* until the pusher elements 106*a* and 106*b* engage an end 162 of the first stack 42 whereupon both the first and second stacks 42 and 44 are essentially combined into one collated stack. From this position, to the downstream position 92, nothing further happens to the completed, collated stack except for movement along the path of travel. The previously discussed inserting machine, which is located further down stream from the downstream position 92 receives the collated stack for deposition to an appropriate envelope or the like. At the instant that the pusher 106*c* leaves an end 164 of the cam member 130, and the end 166 of the movable guide element 118, the movable guide element 118 returns to the inclined position illustrated in FIG. 2**.

It should now be apparent to those skilled in the art that there may be placed a plurality of additional conveyors such as the first and second document stacking and conveying apparatuses previously described and positioned along an extended third document stacking and conveying apparatus so that a larger number of collations than described heretofor may occur. It will be recognized that it is simply a matter of extending the overall length of the third unit, and then adding additional conveying units in parallel relationship along the elongated end of the third unit as required. In addition, it will be noted that it is possible to directly attach a solenoid to the movable guide element 118 and thereby remove much of the linkage, and connecting cam operated devices, however, there are at this point problems associated with a limited stroke provided with solenoids which are overcome by the nature of the parts provided and described for the purpose set forth herein.

Thus, having described a document stacking and conveying apparatus, which is formed of three major components in accordance with the invention, the advantages of stacking a plurality of documents, conveying them and providing a device to enable adding another stack of documents to the first stack may be better appreciated. And, while the present invention as described in the foregoing specification may be easily modified by altering parts and components as depicted in the preceding drawings, it will be recognized that the appended following claims are intended to capture the spirit and scope of the invention at hand.

We claim:

1. A document stacking and conveying apparatus comprising;

A. a pair of elongate document stacking and conveying devices arranged in parallel relationship, each of said document stacking and conveying devices having means for accumulating a plurality of documents into a stack adjacent one end of said document stacking and conveying device and for intermittently feeding said stack beyond said one end, B. a third elongate stacking and conveying device disposed in perpendicular relationship to said pair of document stacking and conveying devices adjacent said one end thereof for receiving said stacks therefrom and for stacking said stacks one on top of another, said third document stacking and conveying device comprising;

1. means adjacent said one end of said pair of document stacking and conveying devices for receiving and supporting said stacks therefrom,
2. conveyor means extending along said third document stacking and conveying device for sequentially moving one of said stacks toward the other stack while said other stack remains stationary on said stack receiving means and for moving both said stacks after said one stack has been deposited on top of said other stack, and
3. means disposed between said stacks for compressing said other stack toward said receiving and supporting means and for guiding said one stack upwardly from said receiving and supporting means whereby said one stack is deposited on top of said other stack by said conveyor means while said other stack remains stationary.

2. A document stacking and conveying apparatus as set forth in claim 1 wherein said compressing and guiding means comprises;

A. a fixed inclined guide element mounted on said receiving and supporting means, B. a movable guide element pivotably connected to the upper end of said fixed guide element and extending in overlying relationship with said other stack, and C. means for moving said movable guide element downwardly to compress said other stack and to guide said one stack on top of said other stack.

3. A document stacking and conveying apparatus as set forth in claim 2 wherein said movable guide element is normally maintained in a normally inclined position sufficiently high to permit said other stack to be deposited on said third document stacking and conveying device beneath said movable guide element.

4. A document stacking and conveying apparatus as set forth in claim 3 wherein said conveyor means comprises an endless member having upper and lower horizontal runs and having a plurality of pusher members mounted thereon in spaced relationship, the spacing between consecutive pusher members being at least as great as the distance between the respective upstream ends of said stacks.

5. A document stacking and conveying apparatus as set forth in claim 4 wherein said means for moving said movable guide element comprises;

A. cam means movably connected to said third document stacking and conveying device adjacent said lower run of said endless member, said cam means being normally biased upwardly, B. means connecting said moveable guide element to said cam means for movement therewith, and C. a cam surface on said pusher members for engagement with said cam means during movement of said pusher members along said lower run for moving said cam means downwardly to depress said movable guide element.

6. A document stacking and conveying apparatus as set forth in claim 5 wherein said cam means comprises an elongate member having a cam surface extending therealong on which said cam surface of said pusher members ride, said cam surface of said cam means being positioned, and having a length, such that a pusher member depresses the cam means only after said other stack has been delivered to said third document stacking and conveying device and maintains said cam means depressed until said one stack is deposited on top of said other stack and both said stacks have been conveyed away from said movable guide element.

* * * * *